US009478350B2

(12) United States Patent
Weber et al.

(10) Patent No.: US 9,478,350 B2
(45) Date of Patent: Oct. 25, 2016

(54) HIGH-VOLTAGE TRANSFORMER

(71) Applicant: ABB Technology AG, Zürich (CH)

(72) Inventors: Benjamin Weber, Winterberg (DE); Jens Tepper, Brilon (DE); Tobias Asshauer, Marsberg (DE); Udo Chudobba, Brilon (DE)

(73) Assignee: ABB Schweiz AG, Baden (CH)

( * ) Notice: Subject to any disclaimer, the term of this patent is extended or adjusted under 35 U.S.C. 154(b) by 16 days.

(21) Appl. No.: 14/515,102

(22) Filed: Oct. 15, 2014

(65) Prior Publication Data

US 2015/0109089 A1 Apr. 23, 2015

(30) Foreign Application Priority Data

Oct. 22, 2013 (EP) ..... 13005035

(51) Int. Cl.

| | |
|---|---|
| ***H01F 30/12*** | (2006.01) |
| ***H01F 27/10*** | (2006.01) |
| ***H01F 27/32*** | (2006.01) |
| ***H01F 5/06*** | (2006.01) |

(52) U.S. Cl.
CPC ..... *H01F 27/32* (2013.01); *H01F 5/06* (2013.01); *H01F 27/322* (2013.01); *H01F 2027/328* (2013.01)

(58) Field of Classification Search
CPC ..... H01F 2027/328; H01F 27/32
USPC ..... 336/5
See application file for complete search history.

(56) References Cited

U.S. PATENT DOCUMENTS 4,173,747 A * 11/1979 Grimes ..... H01F 27/322 336/206

* cited by examiner

*Primary Examiner* — Elvin G Enad
*Assistant Examiner* — Ronald Hinson
(74) *Attorney, Agent, or Firm* — Barnes & Thornburg LLP

(57) ABSTRACT

A high-voltage transformer and method of manufacturing are disclosed. The high-voltage transformer can include a transformer core having at least two core limbs, which are axially parallel and on which in each case a hollow-cylindrical coil having in each case at least one electrical winding is arranged. At least in partial regions of mutually facing surfaces of adjacently arranged coils, the respective surface regions of the coils can have a respective electrically isolating barrier structure, which can be integrated radially on an outside of the coil.

21 Claims, 2 Drawing Sheets

HIGH-VOLTAGE TRANSFORMER

RELATED APPLICATION(S)

This application claims priority under 35 U.S.C. §119 to European Patent Application No. 13005035.4 filed in Europe on Oct. 22, 2013, the entire content of which is hereby incorporated by reference in its entirety.

FIELD

The disclosure relates to a high-voltage transformer including a transformer core having at least two core limbs which can be axially parallel and on which a hollow-cylindrical coil having in each case at least one electrical winding can be arranged.

BACKGROUND INFORMATION

With known high-voltage transformers, for example in the nominal voltage range from, for example, 6 kV, 10 kV, 30 kV, 60 kV, 110 kV and more, measures can be taken for mutual isolation of adjacent coils in order to avoid electrical breakdowns. For example, a simple possibility involves correspondingly increasing the distances between voltage-carrying components; however, the installation size of the high-voltage transformer can be increased as a result. This can apply, for example, to dry-type transformers in which isolation is given merely by the medium of air.

In order to be able to reduce the distance between adjacent coils and hence the installation size of a transformer, known systems arrange so-called intermediate barriers between adjacent coils. These can be essentially plates of an isolating material which can be arranged between the coils and which make it possible, by means of a correspondingly lengthened discharge path along the surface thereof, to arrange the coils in question at a correspondingly shorter distance with respect to one another.

In this type of connection, the space-related can conflict with, for example, the connections of the coils, for example with triangular leads, can occur due to the width of the barrier walls which can be needed for isolation. Connections such as this can be then be guided around the barriers in a complex manner.

In accordance with an exemplary embodiment, the disclosure relates to a high-voltage transformer, which can avoid a separate barrier structure arranged between adjacent coils.

SUMMARY

A high-voltage transformer is disclosed, comprising: a transformer core having at least two core limbs, which are axially parallel; a hollow-cylindrical coil having at least one electrical winding arranged around each of the at least two core limbs; and wherein at least in partial regions of mutually facing surfaces of adjacently arranged coils, a respective surface region of the each coil includes a respective electrically isolating barrier structure, which is integrated radially on an outside of the coils.

A high-voltage transformer is disclosed, comprising: a transformer core having at least two core limbs, which are axially parallel; a hollow-cylindrical coil having at least one electrical winding arranged around each of the at least two core limbs; and an electrically isolating barrier structure, which is integrated radially on an outside of the coils in regions of mutually facing surfaces of adjacently arranged coils.

A method of manufacturing a high-voltage transformer is disclosed, the method comprising: winding a hollow-cylindrical coil having at least one electrical winding around each of at least two core limbs of transformer core, wherein each of the at least two core limbs are axially parallel; and integrating an electrically isolating barrier structure on an outside of the coils in regions of mutually facing surfaces of adjacently arranged coils.

BRIEF DESCRIPTION OF THE DRAWINGS

The disclosure is explained below with reference to the exemplary embodiments shown in the drawings. In the drawings.

DETAILED DESCRIPTION

Figure 1:
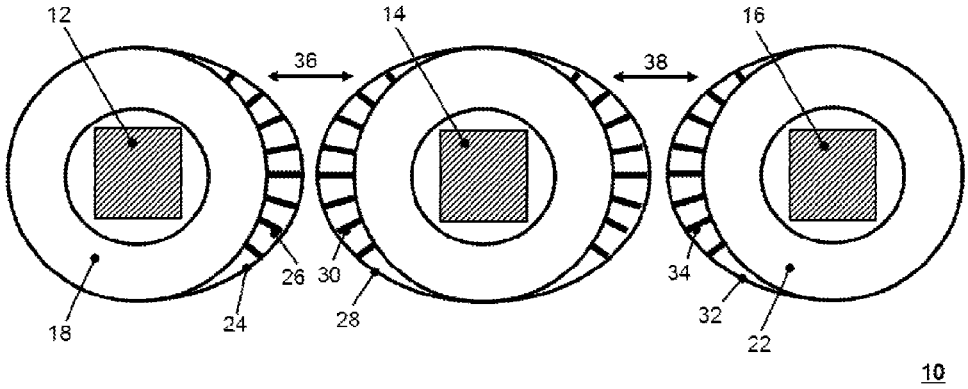
FIG. 1 shows an exemplary high-voltage transformer according to the disclosure.

In accordance with an exemplary embodiment, a high-voltage transformer is disclosed, wherein at least in partial regions of mutually facing surfaces of adjacently arranged coils, the respective surface regions of the coils having a respective electrically isolating barrier structure which is integrated radially on the outside.

In accordance with an exemplary embodiment, a high-voltage transformer is disclosed, which can include integrating a barrier directly in the isolation-critical surface regions of adjacent coils. The isolation-critical surface regions can be those surface regions of adjacent coils, for example, which face towards one another, and wherein, within the surface regions, the highest risk of a breakdown can exist in the case of the respective smallest mutual distance. A respective barrier structure can include the entire axial length of a coil, but can also be somewhat shortened or lengthened, depending on specifications. In accordance with an exemplary embodiment, depending on the type of the transformer core, different mutually facing surface regions emerge. For example, in the case of three coils arranged on an E-type core, for example, two barrier structures which can be arranged radially on the outside and lie mutually opposite emerge for the central coil, wherein in each case one barrier structure arranged radially on the outside can be used for the two outer coils.

In the case of a triangular transformer core, two barrier structures which can be offset by in each case 60° with respect to one another could result, which could expediently be realized by a comprehensive barrier structure.

In the case of a single-phase transformer with a 2-limb core, each of the two coils could be provided with a barrier structure in the region of adjacent coils.

According to an exemplary embodiment of the high-voltage transformer according to the disclosure, the barrier structures can be configured such that the voltage difference occurring between the electrical windings of adjacent coils during operation is maintained without an additional barrier wall arranged between the coils.

In accordance with an exemplary embodiment, an integrated barrier structure can reduce the field strength loading prevailing between the coils such that any additional intermediate barrier is no longer needed. The barrier structure can be, for example, a lens-like attachment to the radially outer surface of a coil. In accordance with an exemplary embodiment, the barrier structure can be integrated in the coil during the manufacturing process of the coil, in a similar manner to the cooling ducts known to those skilled in the art. In accordance with an exemplary embodiment, although cooling ducts cannot be arranged on the surface of the coil, cooling ducts can be arranged between radially adjacent coil segments.

In accordance with an exemplary embodiment, by virtue of correspondingly mechanically fixed integration into the surfaces of the respective coils, the mechanical stability of a transformer can be increased because a mechanically unstable construction of one or more barrier plates arranged between the coils can be dispensed with. In accordance with an exemplary embodiment, in the case of a transformer according to the disclosure, each of the connections of the coils can be guided without geometric impairments.

According to an exemplary embodiment of the transformer according to the disclosure, the barrier structures can includes slats which run axially and which support a barrier wall which is arranged radially opposite. Such a concept can be distinguished by a relatively simple manufacturing process and a relatively high mechanical stability. By way of example, a fibreglass composite material can lend itself as a suitably stable material for the slats.

According to an exemplary embodiment of the high-voltage transformer according to the disclosure, the barrier wall can be at least partially wound from a ribbon-like material. In accordance with an exemplary embodiment, a ribbon-like material, for example a resin-impregnated fibreglass-reinforced fibre bundle which can be heated after the end of the winding process of a coil and then forms a cured structure, is known in the case of winding coils of high-voltage transformers for isolation and stabilization purposes. According to an exemplary embodiment, the radially outer barrier structure can be fixed with such a material or even to partially wind it therefrom, such that both a high mechanical stability and a relatively good isolation capability can be achieved.

According to an exemplary embodiment of the disclosure, the barrier wall at least partially includes a prefabricated cylinder element, for example an isolating half-shell. Cylinder elements or shell elements such as this can be integrated in a relatively simple manner during the winding process of a coil and can be successful in the integration of cooling ducts, for example.

According to an exemplary embodiment of the disclosure, a plurality of radially adjacent layers of slats and barrier walls can be provided in at least regions of the barrier structure. Because of this, for example, both the mechanical stability of the barrier structure and the isolation capability of the barrier structure can be increased.

According to an exemplary embodiment of the disclosure, the barrier structure of at least one coil can be formed over the entire circumference thereof. A barrier structure that runs around 360° is distinguished, for example, by relatively simpler manufacturing, wherein, on the other hand, a slightly increased installation space is needed. If the installation space is available in the case of a respective transformer, the manufacture of the coils can be simplified in this way and it is additionally no longer necessary to be mindful of an orientation of the barrier structure relative to the transformer core.

According to an exemplary embodiment of the high-voltage transformer, the barrier structure of at least one coil is not formed over the entire circumference thereof, wherein the cross section of the barrier structure is marked in a step-like manner at the two outer ends thereof. In accordance with an exemplary embodiment, this exemplary embodiment can be realized in terms of production technology, for example by means of a plurality of slats with shell elements which can be radially superimposed, wherein the two outer steps can be formed by a respective side wall of the respectively outer slats.

According to an exemplary embodiment of the transformer according to the disclosure, the barrier structure of at least one coil is not formed over the entire circumference thereof, wherein the cross section of the barrier structure at the two outer ends thereof transitions in a flat manner into the surface of the coil. In accordance with an exemplary embodiment, this exemplary embodiment lends itself to the case of at least partially wound barrier walls, wherein a respective isolation strip (18, 20, 22, 52, 72) then runs approximately tangentially between the upper edge of a respective outer slat and the surface of the respective coil. In addition, by avoiding a step, a compact surface structure can be formed.

According to an exemplary embodiment, cavities, which act as cooling ducts, can be formed through at least one of the barrier structures, and wherein the cavities can extend over the entire axial length of the barrier structures. A barrier structure is for example very similar to the structure of cooling ducts arranged between radially adjacent coil segments, for example in the scatter channel. In this connection, the chimney effect can be used.

According to an exemplary embodiment of the disclosure, at least one of the barrier structures can project beyond an axial end of the respective coil. This can be beneficial, for example, for controlling the air ratios at the ends of the respective cooling ducts in order to amplify the cooling effect thereof.

FIG. 1 shows an exemplary high-voltage transformer 10 according to the disclosure in a sectional plan view. In each case, a hollow-cylindrical coil 18, 20, 22 can be arranged around three core limbs 12, 14, 16, which can be arranged in a common plane, of a transformer core. Each coil 18, 20, 22 can have a low-voltage winding which lies radially on the inside and a high-voltage winding which lies radially on the outside. Lens-like barrier structures can be integrated in the mutually facing surfaces, which can be indicated by the arrows 36 and 38, of the coils 18, 20, 22, which lens-like barrier structures can be formed in each case by slats 26, 30, 34 and barrier walls 24, 28, 32 which lie radially opposite. In this case, the barrier walls can be prefabricated shell elements, which can be fixed onto the surface of the coils 18, 20, 22 by means of a wound fibre bundle.

Figure 2:
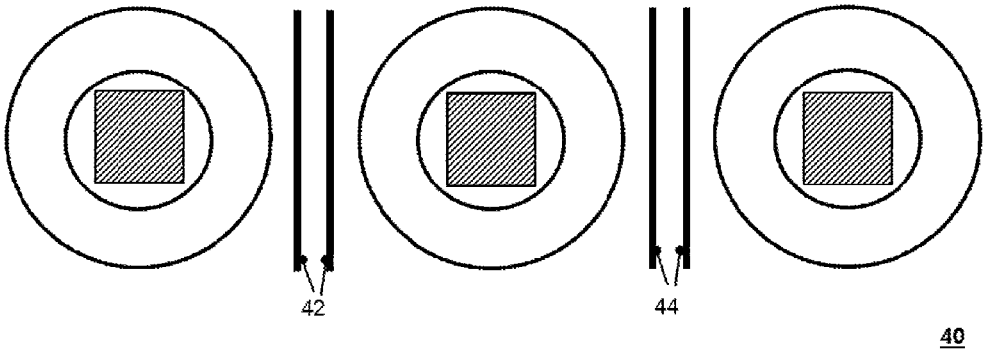
Fig. 2 PRIOR ART
FIG. 2 shows an exemplary known high-voltage transformer.

In contrast to FIG. 1, FIG. 2 shows an exemplary known high-voltage transformer which can have respective barrier walls 42, 44 between adjacent coils, which can be avoided according to the disclosure.

Figure 3:
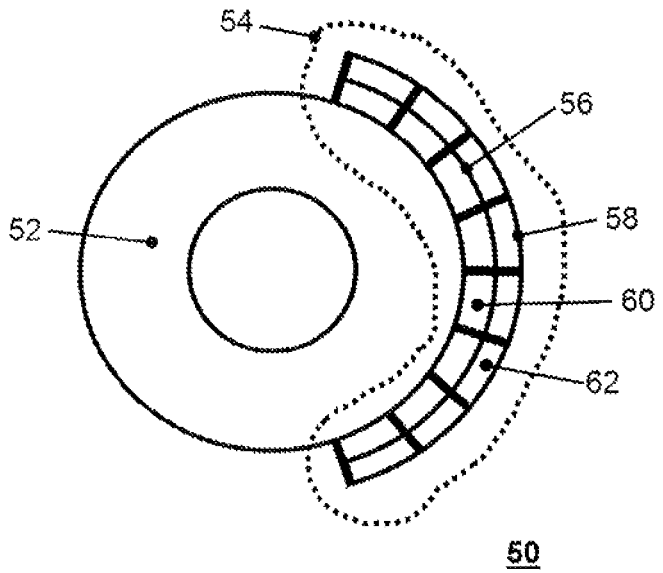
FIG. 3 shows an exemplary hollow-cylindrical coil with barrier structure in accordance with an exemplary embodiment.

FIG. 3 shows an exemplary hollow-cylindrical coil 50 with a barrier structure 54. The barrier structure 54 can be integrated in a partial region of the radially outer surface of a coil 52. The barrier structure 54 can have barrier walls 56, 58, which can be arranged radially one above the other and which can be in each case supported by slats, which run axially. The intermediate spaces between slats and barrier walls can be designed as duct-like cavities 60, 62 and can be used as cooling ducts. The side surfaces of the outer barrier walls 66, 58 form a step-like lateral border of the harrier structure 54.

Figure 4:
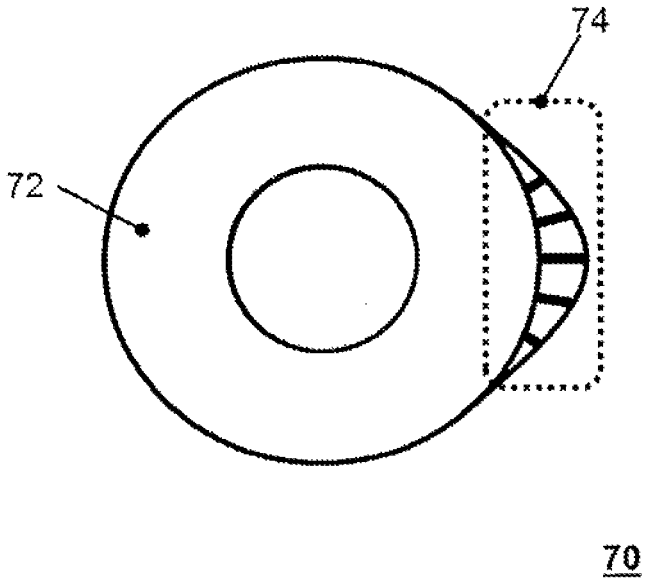
FIG. 4 shows an exemplary hollow-cylindrical coil with barrier structure in accordance with an exemplary embodiment.

FIG. 4 shows an exemplary hollow-cylindrical coil 70 with a barrier structure 74. The barrier structure 74 can be integrated in a partial region of the outer surface of a hollow-cylindrical coil 72 over an angle range of approximately 90°. In accordance with an exemplary embodiment, the barrier wall of the barrier structure 74 can be wound such that it transitions into the surface of the coil 72 in a flat manner.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

10 exemplary high-voltage transformer according to the disclosure
12 first core limb
14 second core limb
16 third core limb
18 first hollow-cylindrical coil of the high-voltage transformer
20 second hollow-cylindrical coil of the high-voltage transformer
22 third hollow-cylindrical coil of the high-voltage transformer
24 barrier wall of the barrier structure of the first coil
26 slat of the barrier structure of the first coil
28 barrier wall of the barrier structure of the second coil
30 slat of the barrier structure of the second coil
32 barrier wall of the barrier structure of the third coil
34 slat of the barrier structure of the third coil
36 first mutually facing surface
38 second mutually facing surface
40 exemplary high-voltage transformer according to the prior art
42 barrier walls
44 barrier walls
50 first exemplary hollow-cylindrical coil with barrier structure
52 first exemplary hollow-cylindrical coil
54 barrier structure of the first exemplary coil
56 first barrier wall of the barrier structure
58 second barrier wall of the barrier structure
60 first cavity (used as cooling duct)
62 second cavity (used as cooling duct)
70 second exemplary hollow-cylindrical coil with barrier structure
72 second exemplary hollow-cylindrical coil
74 barrier structure of the second exemplary coil

What is claimed is:

1. A high-voltage transformer comprising: a transformer core having at least two core limbs, which are axially parallel; and a hollow-cylindrical coil having at least one electrical winding arranged around each of the at least two core limbs; wherein at least in partial regions of mutually facing surfaces of adjacently arranged coils, a respective surface region of the each coil includes a respective electrically isolating barrier structure, which is integrated radially on an outside of the coils, and wherein the barrier structure integrated radially on the outside at least one coil includes a lens shape structure that is attached to an outer surface of the at least one coil without an additional barrier wall arranged between the coils.

2. The high-voltage transformer according to claim 1, wherein the barrier structures are configured such that the voltage difference occurring between the electrical windings of adjacent coils during operation is maintained.

3. The high-voltage transformer according to claim 1, wherein the barrier structures comprises:

slats which run axially and which support a barrier wall, which is arranged radially opposite to the slats.

4. The high-voltage transformer according to claim 3, wherein the barrier wall is at least partially wound from a fibre material.

5. The high-voltage transformer according to claim 3, wherein the barrier wall comprises:

a prefabricated cylinder element.

6. The high-voltage transformer according to claim 3, comprising:

a plurality of radially adjacent layers of slats and barrier walls.

7. The high-voltage transformer according to claim 1, wherein the barrier structure of the at least one coil is formed over an entire circumference of the at least one coil.

8. The high-voltage transformer according to claim 1, wherein the barrier structure of the at least one coil is not formed over an entire circumference of the at least one coil.

9. The high-voltage transformer according to claim 8, wherein a cross section of the barrier structure is stepped at two outer ends of the barrier structure.

10. The high-voltage transformer according to claim 8, wherein a cross section of the barrier structure at two outer ends of the barrier structure transitions in a flat manner into a surface of the coil.

11. The high-voltage transformer according to claim 1, comprising:

cavities, configured as cooling ducts, which are formed through at least one of the barrier structures, the cavities extending over an entire axial length of the barrier structures.

12. The high-voltage transformer according to claim 1, wherein at least one of the barrier structures projects beyond at least one axial end of a respective coil.

13. A high-voltage transformer comprising: a transformer core having at least two core limbs, which are axially parallel; a hollow-cylindrical coil having at least one electrical winding arranged around each of the at least two core limbs; and an electrically isolating barrier structure, which is integrated radially on an outside of the coils in regions of mutually facing surfaces of adjacently arranged coils, wherein the barrier structure of each coil includes a lens shape structure attached to a respective radial outer surface of each coil without an additional barrier wall arranged between the coils.

14. The high-voltage transformer according to claim 13, wherein the barrier structures are configured such that the voltage difference occurring between the electrical windings of adjacent coils during operation is maintained.

15. The high-voltage transformer according to claim 13, wherein the barrier structures comprises:

slats which run axially and which support a barrier wall, which is arranged radially opposite to the slats.

16. The high-voltage transformer according to claim 13, comprising:

a plurality of radially adjacent layers of slats and barrier walls.

17. The high-voltage transformer according to claim 13, wherein the barrier structure of the at least one coil is formed over an entire circumference of the at least one coil.

18. The high-voltage transformer according to claim 13, wherein the barrier structure of the at least one coil is not formed over an entire circumference of the at least one coil.

19. A method of manufacturing a high-voltage transformer, the method comprising: winding a hollow-cylindrical coil having at least one electrical winding around each of at least two core limbs of transformer core, wherein each of the at least two core limbs are axially parallel; and integrating an electrically isolating barrier structure on an outside of the coils in regions of mutually facing surfaces of adjacently arranged coils by attaching a lens shape structure to an outside surface of each coil without an additional barrier wall arranged between the coils.

20. The method according to claim 19, comprising:

maintaining a voltage difference occurring between electrical windings of adjacent coils during operation.

21. The transformer according to claim 1, wherein the barrier structure is located at isolation-critical surface regions of the at least one coil that faces the adjacent coil.

* * * * *